US009650177B2

(12) United States Patent
Raming

(10) Patent No.: US 9,650,177 B2
(45) **Date of Patent: *May 16, 2017**

(54) LINERLESS PACKING AND SHIPPING LABEL SYSTEM

(71) Applicant: Premier Print & Services Group, Inc., Chicago, IL (US)

(72) Inventor: Bruce Raming, Northbrook, IL (US)

(73) Assignee: Premier Print & Services Group, Inc., Chicago, IL (US)

( * ) Notice: Subject to any disclaimer, the term of this patent is extended or adjusted under 35 U.S.C. 154(b) by 804 days.

This patent is subject to a terminal disclaimer.

(21) Appl. No.: 14/093,794

(22) Filed: Dec. 2, 2013

(65) Prior Publication Data

US 2014/0083895 A1 Mar. 27, 2014

Related U.S. Application Data

(63) Continuation of application No. 12/950,644, filed on Nov. 19, 2010, now Pat. No. 8,777,271, which is a continuation-in-part of application No. 12/338,619, filed on Dec. 18, 2008, now Pat. No. 8,109,537.

(51) Int. Cl.

| | |
|---|---|
| ***B65D 25/36*** | (2006.01) |
| ***G09F 3/00*** | (2006.01) |
| ***G09F 3/10*** | (2006.01) |

(52) U.S. Cl.

CPC ..... *B65D 25/36* (2013.01); *G09F 3/0288* (2013.01); *G09F 3/10* (2013.01); *Y10T 156/1062* (2015.01); *Y10T 428/15* (2015.01); *Y10T 428/24752* (2015.01); *Y10T 428/28* (2015.01); *Y10T 428/2813* (2015.01); *Y10T 428/2839* (2015.01); *Y10T 428/2852* (2015.01)

(58) Field of Classification Search

CPC ..... B42D 15/0053; B42D 15/006

See application file for complete search history.

(56) References Cited

U.S. PATENT DOCUMENTS

RE39,100 E * 5/2006 Raming ..... B42D 15/006 156/1

* cited by examiner

*Primary Examiner* — Matthew G Katcoff

(74) *Attorney, Agent, or Firm* — Hovey Williams LLP

(57) ABSTRACT

A linerless duplex label system is operable to print and apply a linerless duplex label to a substrate. A plurality of linerless duplex labels are provided and each label includes a single-ply stock with top and bottom faces. The label also includes an endless adhesive border applied to the bottom face. The adhesive border is an unactivated, selectively activatable adhesive, such labels are overlaid on one another without any substantial adhesion therebetween. Each label may essentially be freely removed from the others, and the adhesive may thereafter be activated so that the label can be adhesively applied to the substrate.

29 Claims, 8 Drawing Sheets

LINERLESS PACKING AND SHIPPING LABEL SYSTEM

RELATED APPLICATION

This is a continuation of application Ser. No. 12/950,644, filed Nov. 19, 2010, entitled LINERLESS PACKING AND SHIPPING LABEL SYSTEM, which is a continuation-in-part of prior application Ser. No. 12/338,619, filed Dec. 18, 2008, entitled LINERLESS PACKING AND SHIPPING LABEL SYSTEM, each of which is hereby incorporated in its entirety by reference herein.

BACKGROUND

1. Field

The present invention relates generally to business forms. More specifically, the present invention concerns a linerless duplex label and package labeling method for providing packing and shipping information for a package.

2. Discussion of Prior Art

Many types of business forms are designed to be adhesively attached to a substrate, such as a product or a product container. For instance, packing and shipping labels are often adhered directly to a box, envelope, or other packaging for shipping a product. Conventional packing and shipping labels are provided as separate labels for each shipping package, with the packing label normally being held by the shipping label so that the contents indicia printed on the packing label are hidden from view. Some prior art shipping labels have been produced in the form of a duplex printed label with shipping indicia on one side and package contents indicia on the other side, and these labels are printed by a conventional duplex printer. The duplex label is also affixed to the package so that the contents indicia is hidden.

Conventional adhesive business forms, including adhesive packing and shipping labels, suffer from various undesirable limitations. For example, adhesive duplex shipping labels are deficient because they involve the use of a label stock, an adhesive pattern on the label stock, and a liner that covers the adhesive pattern when both sides of the duplex label are printed. When the printed label is ready to be applied to a substrate, a portion of the liner is typically removed from the label stock to expose the adhesive and the removed portion of the liner is typically discarded as waste. Thus, where the liner is discarded, the use of a large number of labels generates an undesirable amount of liner waste, and results in an inefficient label application process. Furthermore, the liner is problematic to remove from the duplex label stock using conventional automated label printing and application equipment. Yet further, traditional duplex labels (with portions of the liner being retained on the label for use) have a fairly complex construction and can present a fairly "thick" label construction that can present printing complications.

SUMMARY

Embodiments of the present invention provide a linerless duplex label system that does not suffer from the problems and limitations of the prior art business forms set forth above.

A first aspect of the present invention concerns a linerless duplex label operable to be applied to a package to provide packing and shipping information for the package. The linerless duplex label broadly includes an unfolded single label ply and an unactivated, selectively activatable adhesive layer. The unfolded single label ply includes a central portion and an endless border portion surrounding the central portion. The central and border portions cooperatively present opposite top and bottom faces of the single label ply. The top face is operable to receive package address indicia and the bottom face is operable to receive package contents indicia within the central portion thereof. The unactivated adhesive layer is applied to the bottom face of the single label ply along the border portion of the single label ply, with the border portion of the single label ply operable to be flatly adhered to the package by the adhesive layer once activated so that the label ply is affixed to the package in an unfolded condition. The unactivated adhesive layer presents an inner adhesive edge that defines an endless boundary line between the central and border portions, with the central portion being devoid of adhesive and thereby printable so as to receive the contents indicia thereon. The unactivated adhesive layer permits removable contact of overlaid linerless duplex labels to one another without any substantial adhesion therebetween so that once the label is removed the adhesive layer may be activated and the label adhered to the package.

A second aspect of the present invention concerns a linerless duplex label roll operable to provide packing and shipping labels for packages. The linerless duplex label roll broadly includes a continuous web of a single ply substrate wound in a roll. The single ply substrate presents a plurality of end-to-end duplex labels that each include an unfolded single label ply including a central portion and an endless border portion surrounding the central portion. The central and border portions cooperatively present opposite top and bottom faces of the single label ply. The top face is operable to receive package address indicia and the bottom face is operable to receive package contents indicia within the central portion thereof. The linerless duplex labels each include an unactivated, selectively activatable adhesive layer applied to the bottom face of the single label ply along the border portion of the single label ply, with the border portion of the single label ply operable to be flatly adhered to the package by the adhesive layer once activated so that the label ply is affixed to the package in an unfolded condition. The bottom face of each label removably contacts the top face of at least one other label without any substantial adhesion therebetween so that once the bottom face is removed from contact with the top face of the at least one other label the adhesive layer may be activated and the label adhered to the package.

A third aspect of the present invention concerns a method of labeling a package with a linerless duplex label providing packing and shipping information for the package. The method broadly includes the steps of providing a plurality of overlaid linerless duplex labels each presenting opposite sides, one of which is provided with unactivated, selectively activable adhesive and the other which is at least substantially devoid of adhesive, with at least one linerless duplex label overlying at least one other linerless duplex label and being removably adhered thereto; detaching the first-mentioned linerless duplex label from the at least one other linerless duplex label; printing address indicia on the adhesive-free side of the removed linerless duplex label; printing package contents indicia on the adhesive side of the removed linerless duplex label; activating the adhesive so that the removed linerless duplex label can be adhered to the package by the adhesive; and adhering the removed linerless duplex label to the package in a flat unfolded condition by positioning the adhesive side in adhesive engagement with the package.

Other aspects and advantages of the present invention will be apparent from the following detailed description of the preferred embodiments and the accompanying drawing figures.

BRIEF DESCRIPTION OF THE DRAWING FIGURES

Preferred embodiments of the invention are described in detail below with reference to the attached drawing figures, wherein:

FIG. 1 is a top view of a linerless duplex label that is part of a linerless duplex label system constructed in accordance with a first preferred embodiment of the present invention, showing a single-ply label stock of the linerless duplex label with an endless border portion and a central portion, with perforation lines extending between the border and central portions and defining a tear strip removably connecting the portions, and a transparent release coating applied to a top face of the label stock, with exposed indicia printed on the top face;

Figure 5:
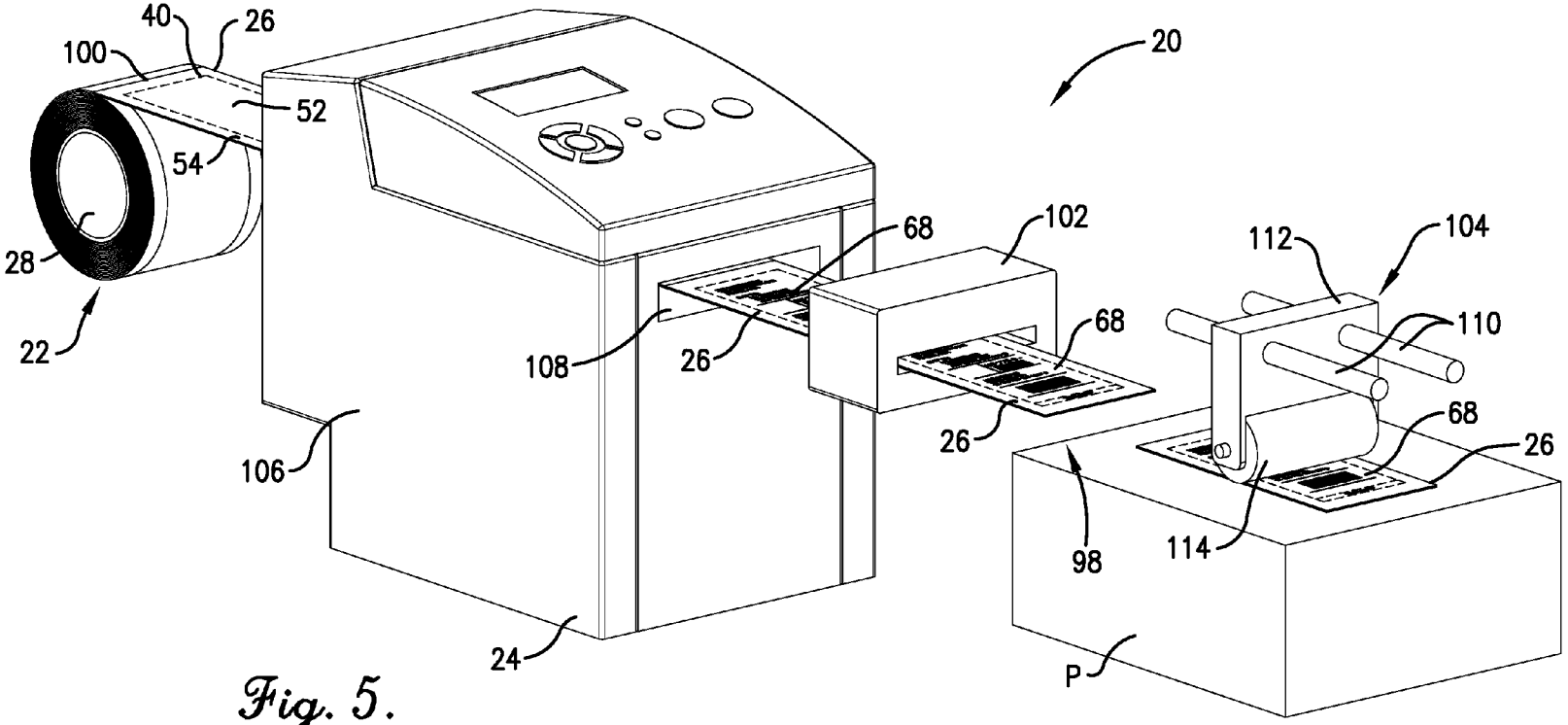
Figure 6:
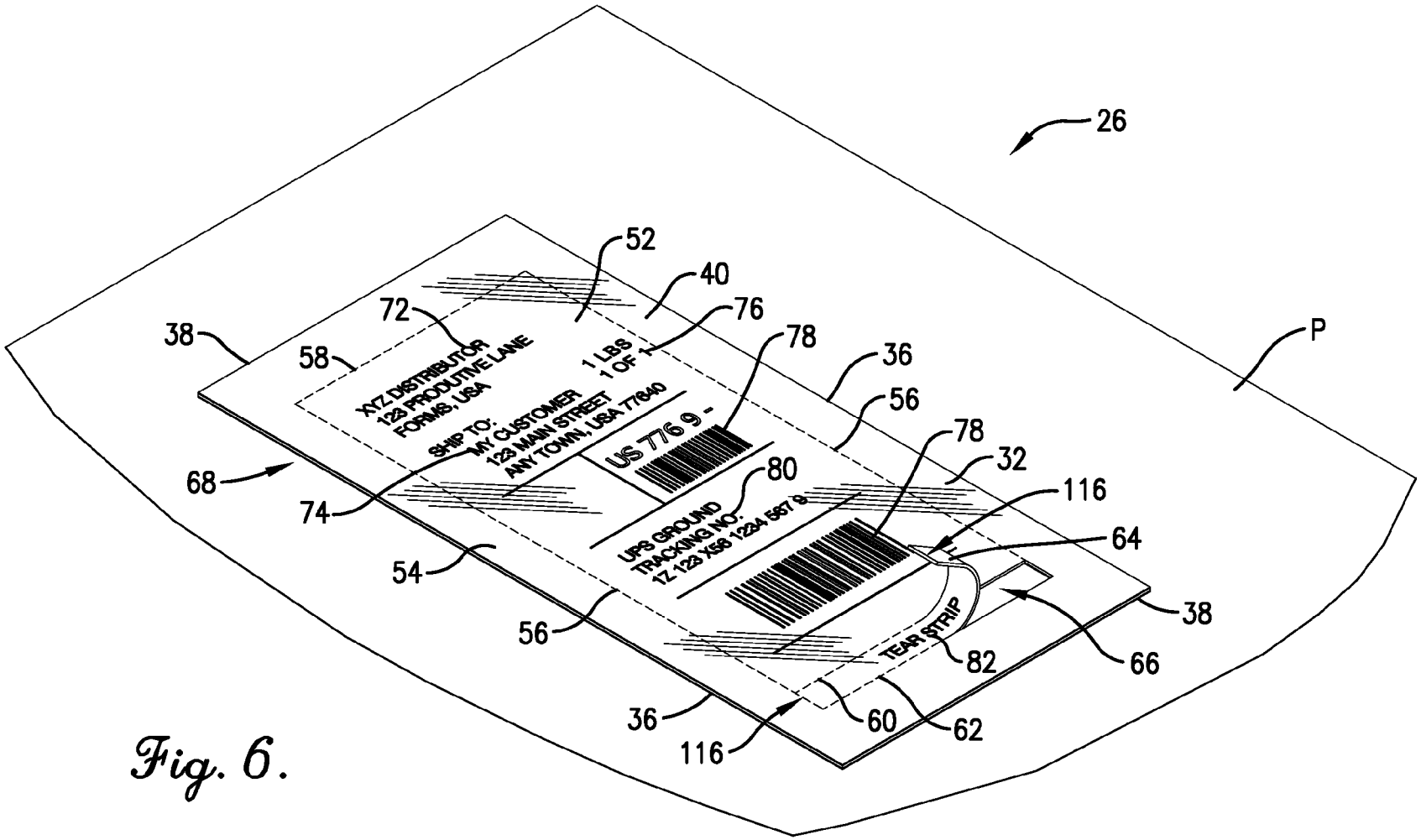
Figure 7:
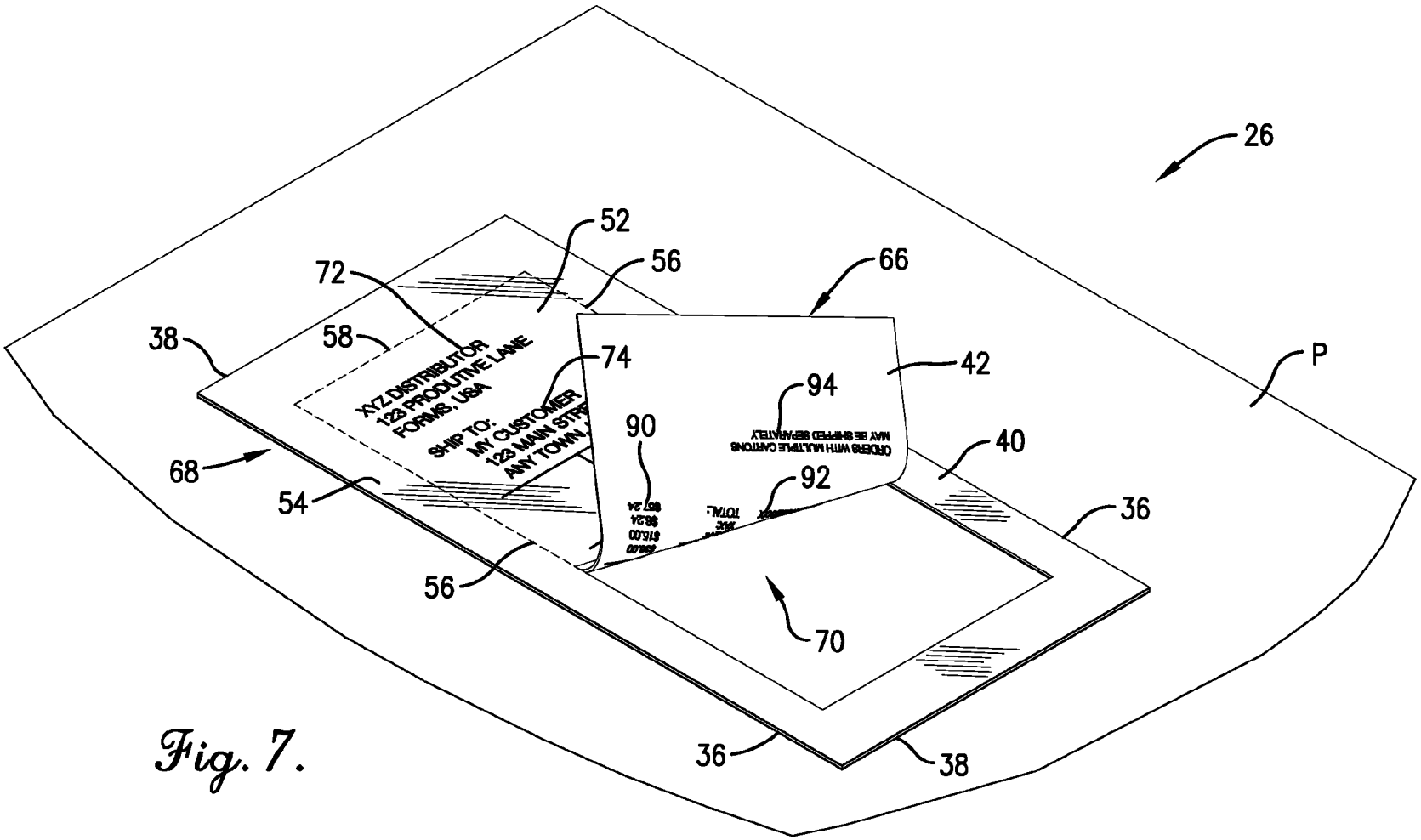
Figure 9:
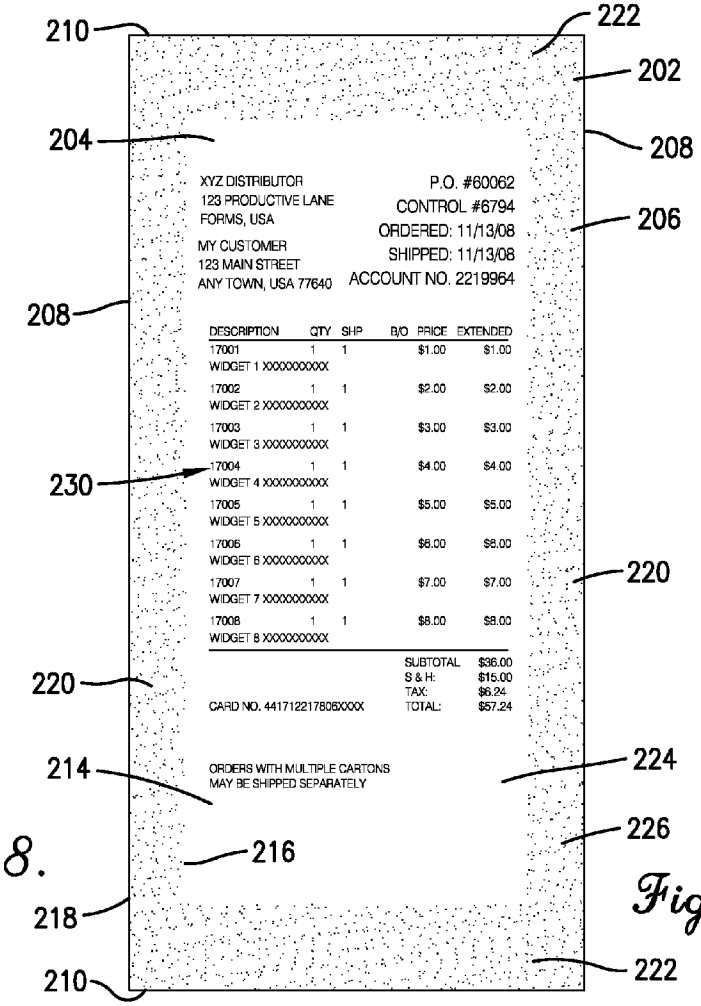
Figure 8:
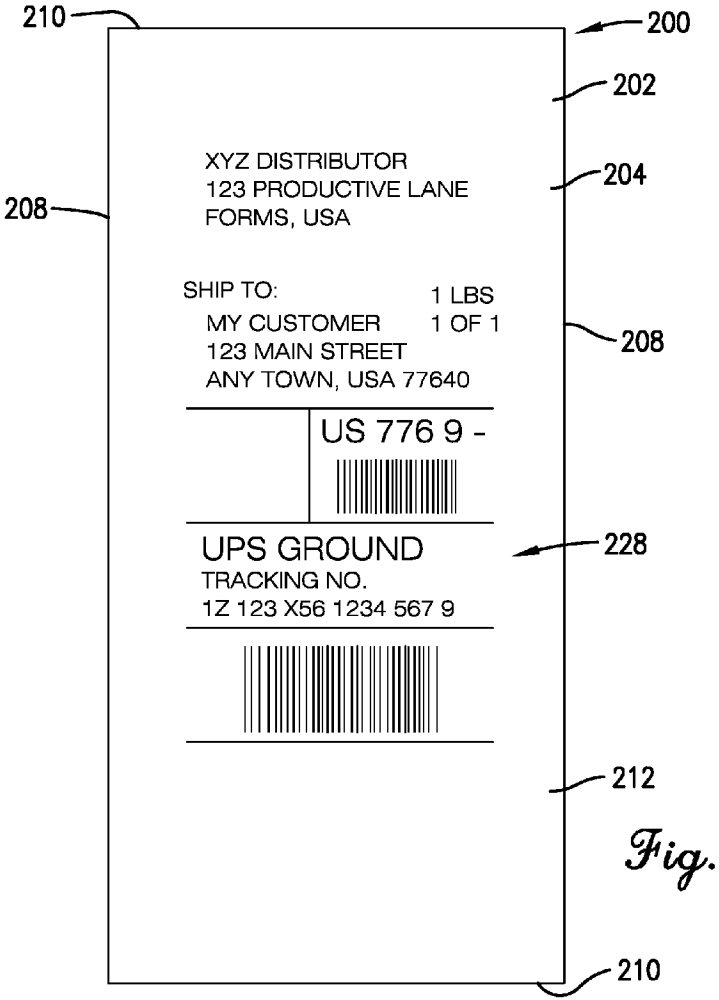
Figure 10:
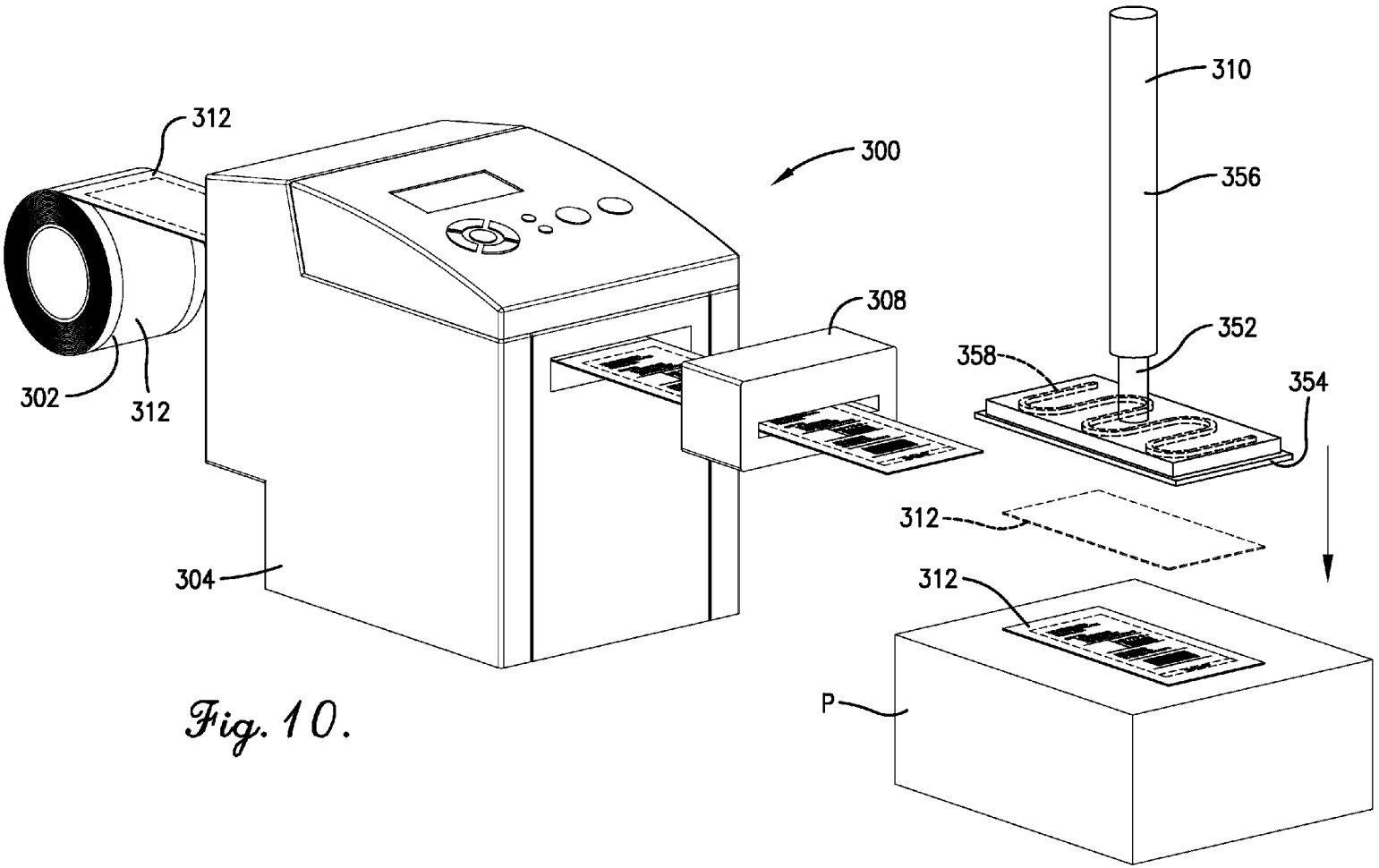
Figure 12:
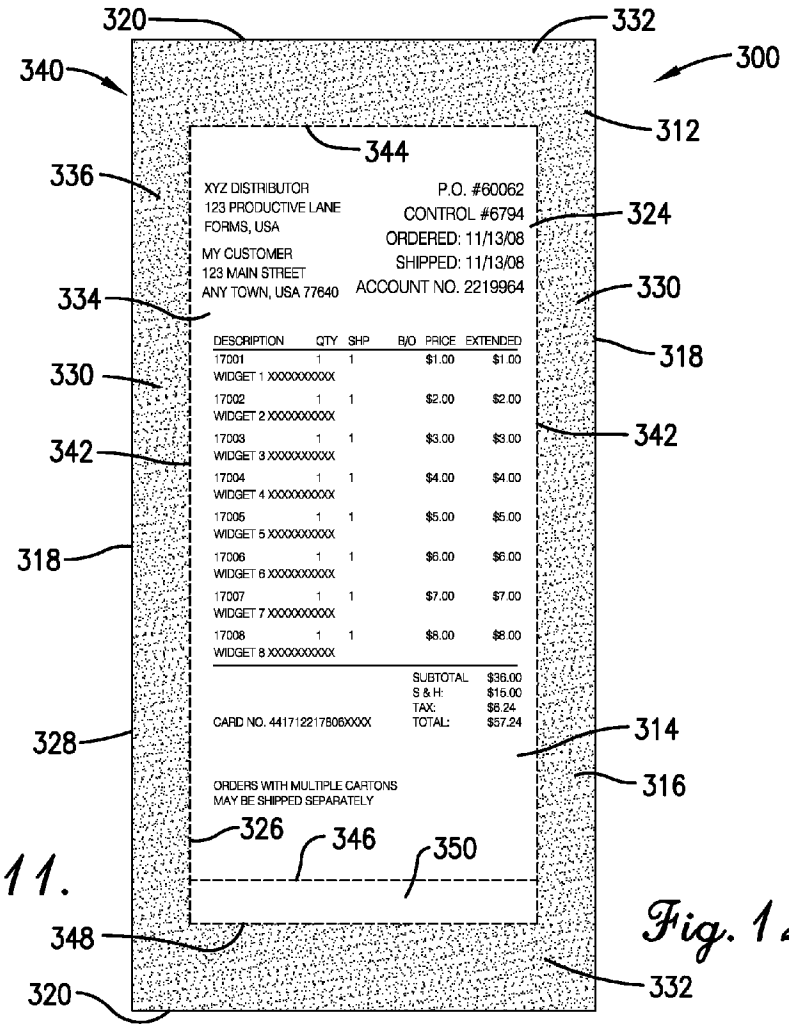
Figure 11:
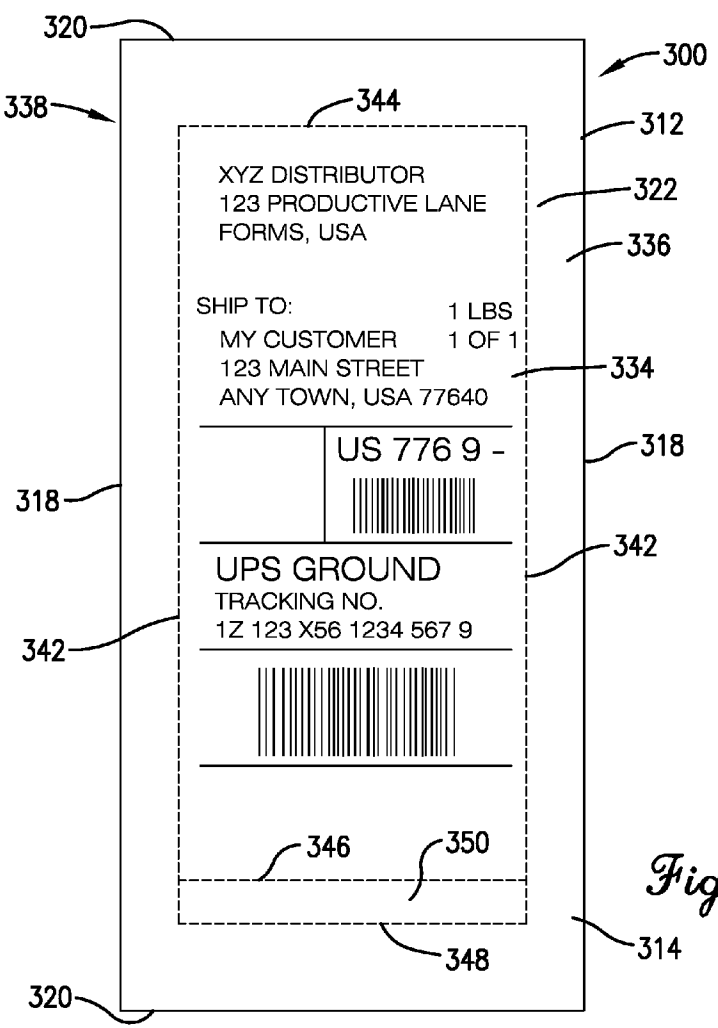

FIG. 5 is a top perspective view of the linerless duplex label system shown in FIGS. 1-4, with the system further including a duplex printer, a cutting mechanism, and a label applicator, and showing the system printing linerless duplex labels from the label roll, cutting the printed labels to detach an end-most label from the label roll, and applying the detached label to a package, with the central portion in a secured configuration;

FIG. 6 is a top perspective view of the linerless duplex label shown in FIGS. 1-5, showing the printed label adhered to the package and the central portion in an unsecured configuration where the tear strip is partly removed to present an unsupported margin of the central portion, with the central portion remaining attached to the border portion and the hidden indicia remaining substantially hidden;

FIG. 7 is a top perspective view of the linerless duplex label shown in FIGS. 1-6, showing the tear strip entirely removed from the adhered label and the central portion of the label partly removed from the border portion to expose the hidden indicia;

FIG. 8 is a top view of a linerless duplex label constructed in accordance with a second preferred embodiment of the present invention, showing a single-ply label stock of the linerless duplex label, with the top face of the label stock devoid of release coating; and FIG. 9 is a bottom view of the linerless duplex label shown in FIG. 8, showing an adhesive layer of the label applied to a bottom face of the label stock, with the adhesive layer being applied to define an endless border portion of the label stock and an adhesive-free central portion of the label stock surrounded by the endless border portion;

FIG. 10 is a top perspective view of a linerless duplex label system constructed in accordance with a third preferred embodiment of the present invention, with the system including a duplex printer, a cutting mechanism, and a label applicator with a heating element, and showing the system printing heat-activatable linerless duplex labels from a heat-activatable label roll, cutting the printed heat-activatable labels to detach an end-most label from the label roll, moving the detached label adjacent a lower pad surface of the label applicator, and applying the detached label to a package using the label applicator, with the central portion in a secured configuration;

FIG. 11 is a top view of the heat-activatable linerless duplex label shown in FIG. 10, showing the top face of the label with an endless border portion and a central portion, with perforation lines extending between the border and central portions and defining a tear strip removably connecting the portions, and with exposed indicia printed on the top face; and FIG. 12 is a bottom view of the heat-activated linerless duplex label shown in FIGS. 10 and 11, showing a heat-activatable adhesive layer of the label applied to a bottom face of the label stock, with the adhesive layer being applied to define the endless border portion of the label stock and the central portion of the label stock that receives hidden indicia.

The drawing figures do not limit the present invention to the specific embodiments disclosed and described herein. The drawings are not necessarily to scale, emphasis instead being placed upon clearly illustrating the principles of the preferred embodiment.

DETAILED DESCRIPTION OF THE PREFERRED EMBODIMENTS

Figure 2:
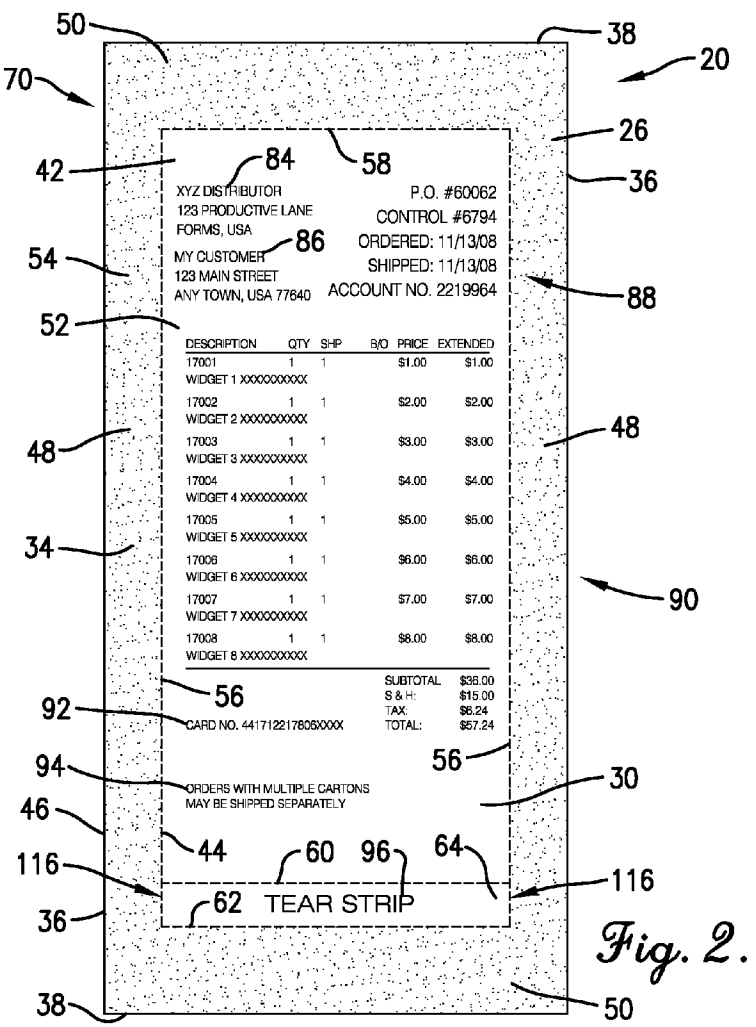
FIG. 2 is a bottom view of the linerless duplex label shown in FIG. 1, showing an adhesive layer of the label applied to a bottom face of the label stock, with the adhesive layer being applied to define the endless border portion of the label stock and the central portion of the label stock that receives hidden indicia.
Figure 1:
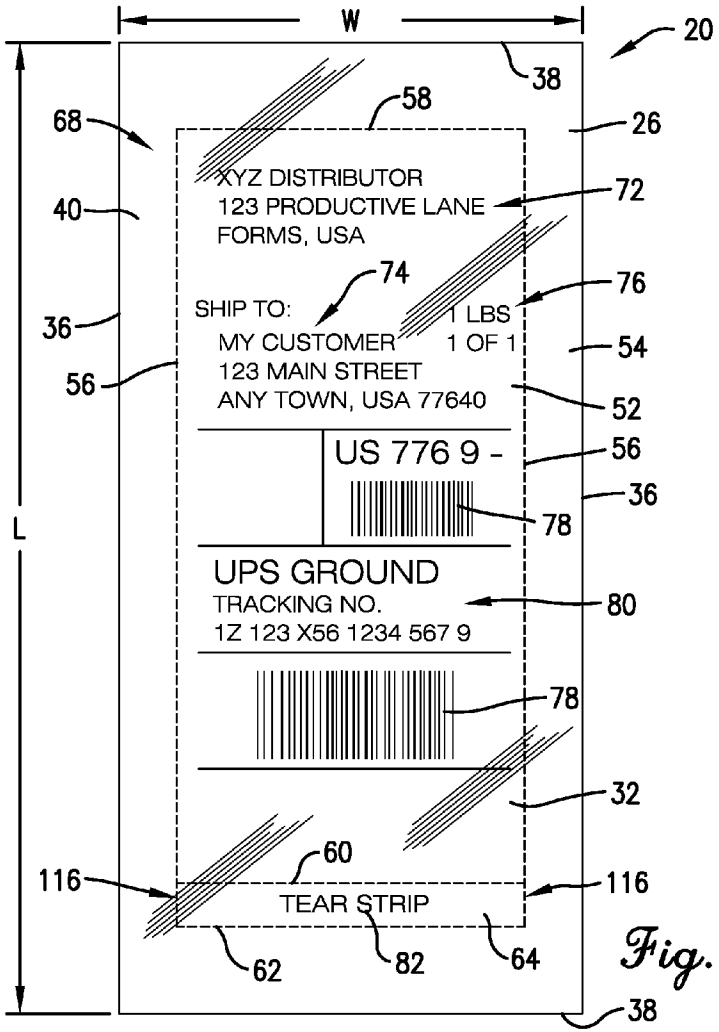
Figure 3:
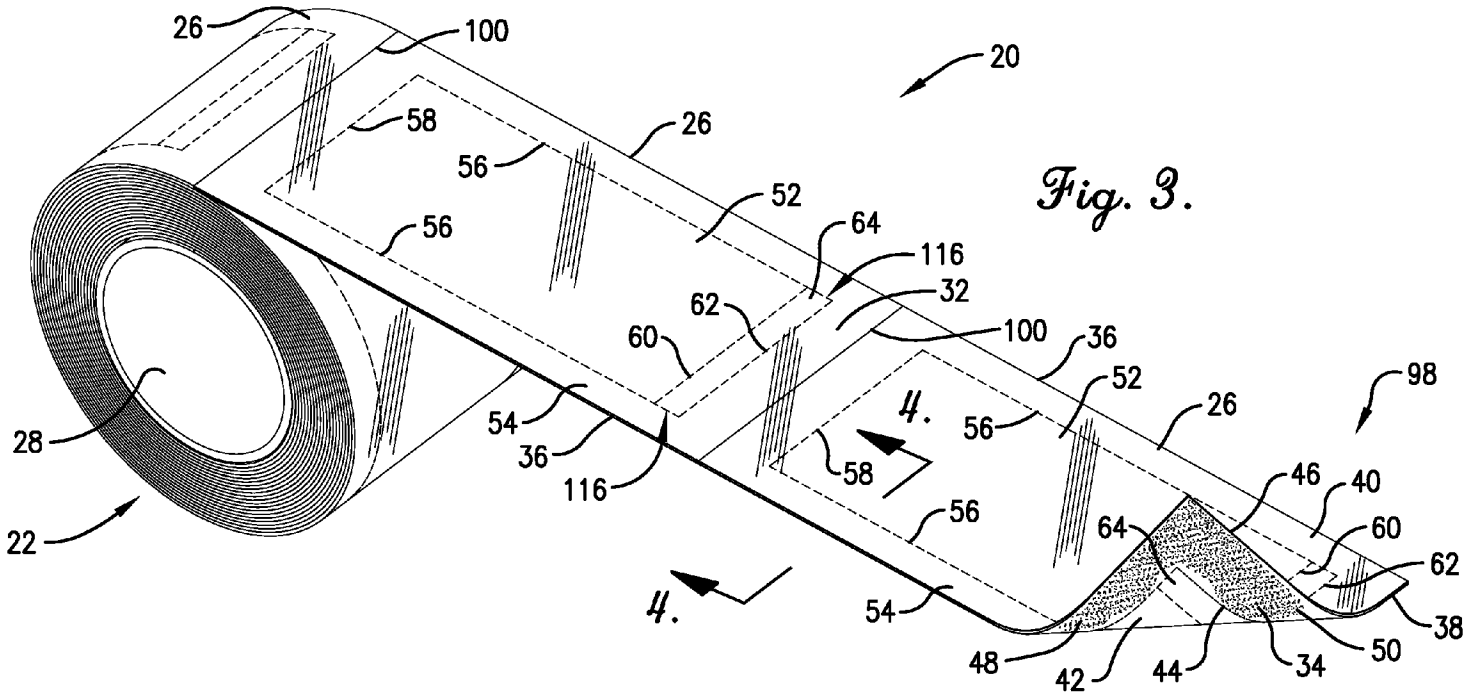
FIG. 3 is a perspective view of a plurality of the linerless duplex labels shown in FIGS. 1 and 2, showing a continuous web of single-ply label stock that presents a plurality of labels attached to end-to-end, with the continuous web being wound in a label roll, and showing the labels prior to being printed with the exposed and hidden indicia.
Figure 4:
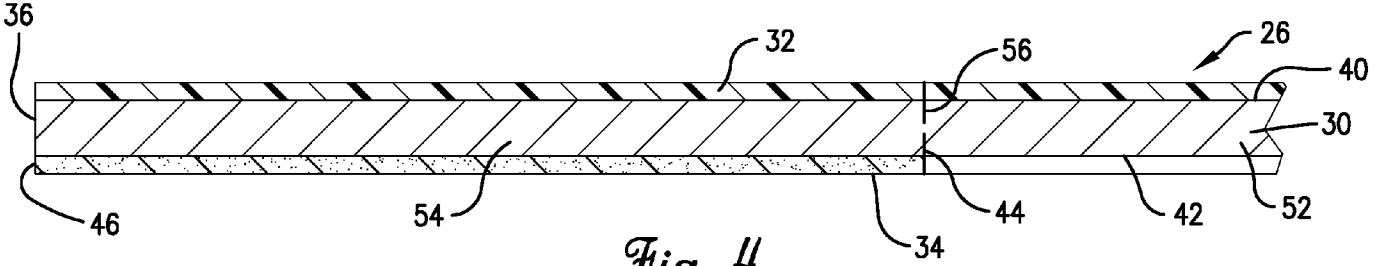
FIG. 4 is a fragmentary cross sectional view of the linerless duplex label taken along line 4-4 in FIG. 3, showing the label stock, release coating, and adhesive layer.

Turning initially to FIGS. 1 and 5, a linerless duplex label system 20 is constructed in accordance with a first preferred embodiment of the present invention. The label system 20 is configured to provide an adhesive duplex shipping and packing label for application on a package P. The linerless duplex label system 20 broadly includes a overlaid label supply 22 and a duplex printer 24.

Turning to FIGS. 1-4, the overlaid linerless label supply 22 is preferably in the form of a continuous roll, which provides a plurality of unprinted duplex labels for printing and application onto a substrate as a shipping and packing label. The label roll 22 includes a plurality of linerless duplex labels 26 attached end-to-end and a sleeve 28. In the preferred embodiment, the label roll 22 includes a continuous web of single-ply direct-thermal stock 30 (i.e., a label substrate) that presents the end-to-end linerless duplex labels 26, and the continuous web is wound in a roll onto the sleeve 28. As will be discussed further, the labels 26 are detachable from the label roll 22.

The linerless duplex labels 26 are each configured to receive packing and shipping information and broadly include thermal printer stock 30, release coating 32, and adhesive layer 34. The thermal printer stock 30 preferably comprises a single-ply direct-thermal stock, but other types of single-ply printer stock could be used without departing from the scope of the present invention. The preferred stock 30 includes opposite side edges 36 that define a substantially continuous width W thereof and opposite end edges 38 that define a length L thereof. Preferably, the width W is in the range of about 1 inch to about 8 inches and, more preferably, about 3 inches to about 5 inches. The length L preferably is in the range of about 1 inch to about 14 inches and, more preferably, about 4 inches to about 10 inches. The illustrated stock 30 also presents opposite top and bottom faces 40,42 that are printable by direct-thermal printing methods. However, the principles of the present invention are equally applicable where the stock 30 is configured to be printed using another printing method, e.g., thermal transfer printing, laser printing, or ink jet printing.

The release coating 32 serves to permit multiple labels 26 to be removably overlaid with one another, as will be discussed further. The release coating 32 preferably comprises a silicone coating applied in a continuous layer on the top face 40 of the thermal printer stock 30. Preferably, the layer of release coating 32 extends continuously to cover the entire top face 40. However, the release coating 32 could be alternatively configured without departing from the scope of the present invention. For instance, the release coating 32 could include a material other than silicone for providing a release mechanism. It is also within the scope of the present invention where the release coating 32 does not completely cover the top face 40. For example, the release coating could alternatively be print-applied within only the border portion (as defined below).

The adhesive layer 34 serves to adhere the label 26 to package P and is applied in an endless border pattern along the bottom face 42 to present inner and outer adhesive margins 44,46. The illustrated adhesive layer 34 preferably extends outwardly so that the outer adhesive margin 46 extends adjacent the edges 36,38 of the stock 30, with substantially no part of the bottom face 42 extending outwardly from the outer adhesive margin 46. This preferred arrangement reduces the risk of inadvertent label removal during shipping. However, the principles of the present invention are also applicable where part of the bottom face 42 extends outwardly from the outer adhesive margin 46, e.g., to provide an outer adhesive-free part of the label 26.

The illustrated adhesive layer 34 extends continuously inwardly from the outer adhesive margin 46 to present side borders 48 and end borders 50 of the endless border pattern, with the inner adhesive margin 44 extending endlessly along the borders 48,50. The inner adhesive margin 44 serves to define a central portion 52 of the stock 30 that is preferably adhesive-free along the bottom face 42, and an endless border portion 54 of the stock 30 that is substantially covered with adhesive along the bottom face 42. However, for some aspects of the present invention, adhesive could be applied to part of the central portion 52, e.g., to further adhere the label 26 to the package P.

Furthermore, the central portion 52 is configured to present a printable section of the bottom face 42 (i.e., the adhesive-free section of the bottom face 42), with the adhesive layer 34 preferably surrounding the central portion 52 to securely conceal the printable section when the label 26 is applied to package P. However, the principles of the present invention are applicable where another section of the bottom face 42 is printable (e.g., a section spaced outwardly from the adhesive layer 34). For some aspects of the present invention, some printing could be done on the adhesive layer 34 itself.

The illustrated adhesive layer 34 preferably comprises a permanent adhesive. As used herein, the term "permanent adhesive" refers to an adhesive that is operable to adhere the stock 30 to the package P or another substrate, with removal of at least part of the stock 30 from the package P resulting in physical damage to either the stock 30 or the package P, with the damage being visibly evident to the naked eye. In this manner, the use of permanent adhesive serves to make the applied label 26 tamper-evident. However, according to some aspects of the present invention (see below), the adhesive layer could alternatively be formed of a temporary adhesive, i.e., adhesive that permits label removal without visibly damaging the stock 30 or package P, is used. Furthermore, another mechanism could be used to cause the label 26 to be tamper-evident.

The label 26 further includes side perforations 56 and end perforations 58,60,62 that permit the label 26 to be separated into a removable center label section and a surrounding label section. In particular, the perforations 56,58,62 are preferably aligned with the inner adhesive margin 44 so that the removable center label section and the central portion 52 of the stock 30 are substantially co-extensive. Thus, the perforations 56,58,62 cooperatively provide an endless line of weakness that defines the central portion 52, with the central portion 52 being entirely removable from the endless border portion 54. However, for some aspects of the present invention, the central portion 52 may not be defined by perforations (e.g., where the label 26 is devoid of perforations 56,58,60,62, as will be shown in a subsequent embodiment depicted in FIGS. 8 and 9). It is also within the ambit of the present invention where the perforations 56,58,62 are spaced inwardly from the inner adhesive margin 44 (e.g., to ensure that no adhesive is applied to the removable center label section) or outwardly from the inner adhesive margin 44 (e.g., to permit limited adhesive engagement between the removable center label section and the package P when the label 26 is applied to the package P).

Perforation 60 extends along the central portion 52 between perforations 56 and is inwardly spaced from and adjacent to perforation 62. Perforations 56,60,62 cooperatively define a tear strip 64 of the central portion 52 that connects portions 52,54 of the stock 30 to each other. The illustrated tear strip 64 is removable to present an unsupported margin 66 of the central portion 52 adjacent an end of the label 26. The unsupported margin 66 permits a user to grab both faces 40,42 along the margin 66 and remove the central portion 46 from the endless border portion 48 by pulling the margin 66 in a direction toward the opposite end of the label 26. The illustrated tear strip 64 is preferably positioned at one end of the central portion 52, but could be alternatively positioned (e.g., along one side of the central portion 52) without departing from the scope of the present invention.

The tear strip 64 preferably terminates at the endless border portion 54 so that the tear strip 64 is spaced from the edges 36,38 of the stock 30. However, for some aspects of the present invention, one or both ends of the tear strip 64 could be alternatively positioned along the label. For instance, one or both tear strip ends could extend to the respective side edge 36 (e.g., to provide convenient access to the tear strip end).

The printed label 26 includes top and bottom indicia 68,70 on respective top and bottom faces 40,42. As will be shown, the indicia 68,70 may include variable indicia (i.e., indicia that can vary with each label and associated package P) and non-variable indicia (i.e., indicia that generally does not change from label to label or from order to order). Furthermore, some of the indicia may be preprinted (e.g., before the single-ply substrate is wound into roll 22). The top indicia 68 presented on top face 40 includes sender address indicia 72, recipient address indicia 74, package size and package number indicia 76, bar code indicia 78 operable to provide a unique identifier associated with the package P that can be electronically scanned, package tracking indicia 80 operable to identify the carrier and a unique carrier tracking number associated with the package, and tear strip indicia 82. The top indicia 68 illustrated on the top face 40 is all printed on the central portion 52, but the principles of the present invention are applicable where at least some indicia is printed on the endless border portion 54. As will be discussed further, the top indicia 68 is generally exposed and visible when the label 26 is applied to the package P.

The bottom indicia 70 presented on the bottom face 42 includes sender address indicia 84, recipient address indicia 86, purchase order indicia 88 that includes a purchase order number, control number, customer account number, and order and ship dates of the purchase, package contents and billing indicia 90 that provides an itemized list of the package contents, the cost of each item listed alongside the corresponding item, the subtotal, shipping and handling cost, tax, and total cost, credit card indicia 92 including part of the customer's credit card number, order information indicia 94, and tear strip indicia 96. The bottom indicia 70 illustrated on the bottom face 42 includes information confidential to the sender and recipient. Therefore, the bottom indicia 70 is printed on the central portion 52 and is generally hidden from view when the label 26 is applied to the package P. However, the principles of the present invention are applicable where at least some indicia printed on the bottom face 42 is printed on another portion of the bottom face 42 (e.g., where part of the bottom face 42 extends outside of the adhesive border and is configured to receive printed indicia). Thus, some of the indicia on the bottom face 42 could be viewable without removing the applied label 26.

The top and bottom indicia 68,70 are preferably printed by direct-thermal printing, but each of the indicia 68,70 could be printed by other printing methods, such as thermal transfer, laser, ink jet printing, or a combination of printing methods. It is also within the scope of the present invention where the top indicia 68 is printed by one printing method and the bottom indicia 70 is printed by a different printing method. For instance, one of the indicia 68,70 could be printed by direct-thermal printing and the other one of the indicia 68,70 could be printed by thermal transfer printing. Also, one of the indicia 68,70 could be printed by ink jet printing and the other one of the indicia 68,70 could be printed by direct-thermal printing.

The indicia 72,82,84,96 generally comprise non-variable indicia. Indicia 74,76,78,80,86,88,90,92 generally includes variable indicia. Thus, both faces of the label 26 include variable indicia, and variable indicia on both faces of the label 26 can be associated with a particular order for the contents of package P. As will be discussed further, in printing indicia on both label faces, the indicia on the top face 40 can be matched with the indicia on the bottom face 42 to provide all of the indicia associated with the corresponding order. This facilitates proper shipment of the correct items to the correct recipient.

The illustrated label 26 is configured so that confidential indicia, such as the package contents indicia 90 and credit card indicia 92, is only located on the bottom face 42 along the central portion 52 and is thereby hidden when the label 26 is applied to package P. Thus, the label 26 must be at least partly removed from the package P to access the confidential indicia. Due to this tamper-evident label construction, the label 26, the package P, or both are visibly damaged when the label 26 is at least partly removed from the package P.

The top and bottom indicia 68,70 comprise the only information associated with the package P that is carried by the illustrated label 26 for visual and electronic identification (by the sender, distributor, or recipient) of the package P and the associated order. But it is also within the ambit of the present invention where the label 26 includes other package or order identification features, e.g., other types of machine-readable features. For instance, the label 26 could include an RFID tag attached to the stock 30 that can carry information in electronic form and can be electronically programmed and read.

The labels 26 are attached end-to-end to form the continuous web, and the web is wound to form the roll 22. In particular, the labels 26 are arranged so that the top and bottom faces 40,42 each extend continuously along the length of the web. Thus, the web is mounted to the sleeve 28 with the adhesive bottom face 42 adhesively engaging the sleeve 28. As the web is wound to form the roll 22, the adhesive bottom face 42 of each label 26 engages and overlies the top face 40 of the underlying label 26 on the roll 22. The release coating 32 on the top face 40 permits removable adhesion between adjacent overlaid labels 26 on the roll 22 so that the labels 26 are removable from each other without becoming damaged. The end-most label 26, i.e., the label at an exposed end 98 of the web, can be removed from overlaid engagement with the label 26 therebelow and can be separated from the web at cue mark location 100 between itself and the adjacent label 26, as will be discussed.

Turning to FIG. 5, the linerless duplex label system 20 is configured to print and apply a duplex packing and shipping label to package P and includes the label roll 22, duplex printer 24, cutter 102, and label applicator 104. The duplex printer 24 is configured to print the label 26 in a single printing pass, as will be discussed. The duplex printer 24 includes a housing 106 that presents a form inlet (not shown) that receives the incoming web and a form outlet 108 through which the printed web is discharged from the printer 24. The duplex printer 24 includes upper and lower print heads (not shown) positioned within the printer housing for printing indicia on corresponding top and bottom faces 40,42. The label roll 22 is rotatably supported by a frame (not shown) adjacent the form inlet of the duplex printer 24.

As the web passes through the duplex printer 24, the top and bottom faces 40,42 may be printed by the duplex printer 24 either simultaneously or sequentially (e.g., by printing the bottom face 42 after printing the top face 40) during the single printing pass. The single printing pass may likely involve some back-and-forth movement of the label 26 as the label 26 is being printed (e.g., to permit printing of the label 26 by multiple print heads), but it is also within the scope of the present invention where the label 26 is fed continuously through the printer 24 at a constant speed during printing of the label 26.

The illustrated duplex printer 24 is preferably a direct-thermal printer, but the principles of the present invention are equally applicable where the printer 24 includes another type of print head, such as thermal transfer head, a laser head, or an ink jet head, or a combination of print head types. For instance, the printer 24 could have one type of print head that serves as the upper print head to print the top face 40 and another type of print head spaced below the upper print head and serving as the lower print head to print the bottom face 42. Furthermore, multiple types of print heads could be used to print either the top or bottom faces 40,42. While all of the illustrated indicia on label 26 is printed by the printer 24 using direct-thermal printing, it is also within the scope of the present invention where at least some of the indicia on label 26 is printed using thermal transfer, laser, or ink jet printing. Furthermore, some of the indicia, particularly the non-variable indicia, could be pre-printed on the continuous web (i.e., prior to printing by the duplex printer 24).

As discussed above, the linerless duplex label system 20 is operable to print the label 26 on both faces 40,42 with variable indicia, such as recipient address indicia 74 and package contents and billing indicia 90. All of the variable indicia printed on label 26 is associated with the particular package P, the contents of the package P, and the recipient of the package. Therefore, the system 20 associates (or matches) all of the variable indicia for each label 26 prior to printing of the label 26. For example, the system 20 could include a computer (not shown) for compiling and associating the information for each label 26. The system 20 also provides printing instructions to the printer 24 so that the associated (or matched) indicia is printed on the same label 26. It is also within the scope of the present invention where only some portions of the variable indicia printed on the label 26 are associated with each other. Also, while the illustrated variable indicia is associated with the corresponding package P, some variable indicia could be associated by another type of association (e.g., the recipient address indicia 86 and the account number of the purchase order indicia 88 can be associated with the name of a recipient).

The cutter 102 comprises a conventional cutting mechanism for cutting the end-most label 26 from the rest of the continuous web. The cutter 102 includes a housing and a cutting blade (not shown). The illustrated cutter 102 includes a sensor (not shown) that identifies when the cue mark location 100 reaches the blade, with the cutter 102 then shifting the blade to make a transverse cut along the cue mark location 100 to separate the end-most label 26 from the web. However, it is also within the scope of the present invention where the cutter 102 is operable to make a cut along the location 100 without sensing a cue mark. For instance, the system 20 could be programmed to feed the continuous web a predetermined length and then cut the label 26 to the predetermined length, with the system 20 being operable to cut multiple labels 26 to the same predetermined length. The illustrated cutter 102 is mounted externally to the printer 24, but could be an integral component of the printer 24 without departing from the scope of the present invention. Furthermore, cutting of the end-most label 26 could occur before or after printing of either face 40,42. While the end-most label 26 is preferably separated from the web by the cutter 102, it is within the scope of the present invention where the end-most label 26 is separated by another mechanism. For instance, the web could include a line of weakness extending along each location 100 and the labels 26 could be separated by a mechanism that bursts or tears the web along the line of weakness.

The label applicator 104 includes a conventional roller applicator and includes a frame 110, a roller head 112, and a roller 114 rotatably mounted on the head 112. The head 112 and roller 114 are operable to slide along the frame 110, with the roller 114 engaging a top surface of the package P. As the printed label 26 is machine-fed into a position adjacent the top surface of the package P, roller 114 rolls over the top face 40 of label 26 from one end to the other and thereby presses the label 26 onto the package P. The adhered label 26 is positioned in a secured configuration where the bottom indicia 70 is hidden and the central portion 52 is fully attached to the border portion 54 along the endless line of weakness formed by the perforations 56,58,62 to restrict exposure of the bottom indicia 70. Again, it is within the scope of the present invention where some indicia printed on the bottom face 42 can be viewed once the label 26 is applied to the package P and before the label 26 is removed (e.g., where indicia are printed on a flap of the endless border portion 54 spaced outwardly from the adhesive layer 34, with the flap operable to be shifted to expose the indicia). Furthermore, the label 26 is preferably adhered in a flat, unfolded condition. It has been found that applying the label 26 in a flat and unfolded condition on package P is preferable, particularly for packing and shipping labels, because the label 26 is resistant to inadvertent damage or removal caused by package handling and distribution. Importantly, the illustrated label 26 effectively resists damage caused by exposure to handling equipment of large-volume parcel shippers.

The illustrated system 20 is preferably configured to operate as an automatic label print and apply station that is electronically operated and can apply printed labels to a plurality of packages P. But the principles of the present invention are applicable where some steps of the label print and application process are performed manually. Because the system 20 is configured to print variable indicia on both label faces, the system 20 can also apply labels to a plurality of packages P, where each package P has at least some indicia that is different from the other packages P. For instance, the system 20 is operable to print and apply labels to multiple packages P, with each package having different contents and each label 26 having different package contents indicia. Similarly, the recipient address indicia is likely different between each package.

Turning to FIGS. 6 and 7, the central portion 52 of the applied label 26 is removable from the endless border portion 54 by initially separating the tear strip 64 from the portion 54. In particular, one end 116 of the tear strip 64 is grabbed and drawn by the user toward the other end 116 of the tear strip 64. The tear strip 64 can be either partly or completely removed, and this separation of the tear strip 64 leaves the label 26 in an unsecured configuration where the bottom indicia 70 is no longer securely concealed. Furthermore, the unsupported margin 66 of the central portion 52 is exposed to permit the user to grab the margin 66 on both faces 40,42. The margin 66 can then be drawn away from the endless border portion 54 to separate the central portion 52 from the endless border portion 54 to a greater degree and further enable viewing of bottom indicia 70, as shown in FIG. 8. The central portion 52 can also be completely detached from the endless border portion 54. In this instance, the detached central portion 52 serves as a packing slip that can be processed by the package recipient, e.g., to confirm that the contents ordered were actually shipped in the package, and can be saved as a record of the transaction.

In operation, the linerless duplex label system 20 is operable to efficiently apply packing and shipping labels to multiple packages while minimizing label waste and incidences of equipment failure. The label roll 22 dispenses the continuous web of labels 26 into the printer 24 by unrolling a label 26 from overlaid adhesion with another label 26. That is, an outer label 26 is unrolled from an adjacent inner label 26 by separating the adhesive face of the outer label 26 from the adhesive-free face of the inner label 26. Again, the illustrated labels 26 include no pre-printed indicia, although some pre-printed indicia may be included on the continuous web prior to printing with printer 24 if desired. As labels 26 pass from the form inlet to the form outlet 106 in a single printing pass, indicia 68,70 is printed on top and bottom faces 40,42. The printed labels 26 then pass out of the form outlet 108 and into the cutter 102 so that the end-most label 26 is separated from the rest of the continuous web. The separated label 26 is then positioned adjacent the package P, and the label applicator 104 adheres the label 26 onto the package P in a flat and unfolded condition. The bottom face 42 of the adhered label 26 is positioned in adhesive engagement with the package P, and the indicia 70 printed on the bottom face 42 is thereby hidden by the adhered label 26 and package P in a secured label configuration. In addition, the top face 40 is exposed to permit viewing and electronic scanning of indicia 68 printed thereon. The system 20 is configured to print and apply a plurality of labels 26 to corresponding packages P, with the indicia on each side of the label 26 being matched with each other and with the package P. The bottom indicia 70 printed along the central portion 52 is exposed for viewing by first removing the tear strip 64 from the portions 52,54 to present the unsupported margin 66. The recipient can then grasp the exposed margin 66 to remove the central portion 52 from the endless border portion 54, with the central portion 52 thereby serving as a packing slip (or packing list). Without departing from the scope of the present invention, the illustrated central portion 52 could alternatively be used and/or referred to as a carton contents list or an invoice.

Turning to FIGS. 8 and 9, an alternative linerless duplex label system 200 including an alternative linerless duplex label 202 is constructed in accordance with a second preferred embodiment of the present invention. For the sake of brevity, the remaining description will focus primarily on the differences of this embodiment relative to the embodiment illustrated in FIGS. 1-7.

The alternative linerless duplex label 202 is configured to receive packing and shipping information and broadly includes thermal printer stock 204 and adhesive layer 206. The thermal printer stock 204 comprises a single-ply direct-thermal stock and includes side and end edges 208,210. The illustrated stock 204 also presents opposite top and bottom faces 212,214 that are printable by direct thermal printing methods.

The adhesive layer 206 serves to adhere the label 202 to the package and is applied in an endless border pattern along the bottom face 214 to present inner and outer adhesive margins 216,218. The illustrated adhesive layer 206 extends continuously inwardly from the outer adhesive margin 218 to present side borders 220 and end borders 222 of the endless border pattern, with the inner adhesive margin 216 extending endlessly along the borders 220,222. The inner adhesive margin 216 serves to define a central portion 224 of the stock 204 that is preferably free of adhesive, and an endless border portion 226 of the stock 204 that is substantially covered with adhesive. The illustrated adhesive layer 206 comprises a temporary adhesive, i.e., adhesive that permits label removal without damaging the stock 30 or package P. The temporary adhesive permits each label 202 to be removed from overlaid adhesive engagement with one or more other labels 202 (e.g., when the labels 202 are wound onto a label roll). Moreover, the use of temporary adhesive permits removable adhesion between labels 202 with the top face 212 being devoid of release coating.

The central portion 224 is also configured to present a printable section of the bottom face 214, with the adhesive layer 206 preferably surrounding the central portion 224 to securely conceal the printable section when the label 202 is applied. The linerless duplex label 202 further includes top and bottom indicia 228,230 printed on the top and bottom faces 212,214. The bottom indicia 230 is printed on the printable section of the bottom face 214.

The label 202 is printed and applied to the package P similar to the process of printing and applying the label 26. The applied label 202 also is adhered to the package P so that the top indicia 220 is exposed and readily viewed and the bottom indicia 222 is cooperatively hidden from view by the label 202 and the package P. However, label 202 is devoid of any perforations or lines of weakness spaced within the edges 208,210. Thus, the use of temporary adhesive in the adhesive layer 206 permits the bottom indicia 230 to be exposed for viewing by separating the label 202 as a whole from the package P. Furthermore, the entire label 202 is completely detached from the package P to serve as a packing slip. However, for some aspects of the present invention, the adhesive layer 206 could include a permanent adhesive.

Turning to FIGS. 10-12, an alternative linerless duplex label system 300 is constructed in accordance with a third preferred embodiment of the present invention. The linerless duplex label system 300 broadly includes an overlaid label supply 302, duplex printer 304, cutter 308, and a label applicator 310.

The overlaid label supply 302 preferably includes a plurality of linerless duplex labels 312 attached end-to-end in a label roll. However, it is also within the ambit of the present invention where the label supply 302 has an alternative configuration (e.g., to permit automated label feeding to the printer). For instance, labels 312 could be attached end-to-end and separated by perforations, but folded on top of each other to form a fanfold label supply (i.e., so that the top faces or bottom faces of adjacent labels generally oppose each other). The label supply 302 is formed of a continuous web of thermal printer stock 314 and a heat-activatable adhesive layer 316. The label supply 302 is preferably devoid of any release coating or layer, such as the release coating 32 disclosed in the first-mentioned embodiment. The thermal printer stock 314 preferably comprises a single-ply direct-thermal stock and includes side and end edges 318, 320. The illustrated stock 314 also presents opposite top and bottom faces 322,324 that are printable by direct thermal printing methods. As will be discussed, the principles of the present invention are applicable where the stock 314 is printed using direct-thermal printing, thermal transfer printing, laser printing, ink jet printing, or combinations thereof.

The adhesive layer 316 serves to adhere the label 312 to the package P and is preferably applied in an endless border pattern along the bottom face 324 to present inner and outer adhesive margins 326,328. The illustrated adhesive layer 316 extends continuously inwardly from the outer adhesive margin 328 to present side borders 330 and end borders 332 of the endless border pattern, with the inner adhesive margin 326 extending endlessly along the borders 330,332. The inner adhesive margin 326 serves to define a central portion 334 of the stock 314 that is preferably free of adhesive, and an endless border portion 336 of the stock 314 that is substantially covered with adhesive. If desired, the adhesive layer could alternatively be applied in a pattern or in intermittent sections along the border portion without departing from the scope of the present invention.

The adhesive layer 316 preferably comprises a heat-activatable adhesive material. One suitable heat-activatable adhesive is available as Silgon™ Linerless Adhesive from Polykote Corp. of Easton, Pa. For some aspects of the present invention, the adhesive layer 316 could include another type of activable adhesive, such as a water-activatable adhesive or a light-activatable adhesive. For instance, suitable water-activatable adhesives may include remoistenable glues, gums, and hot-melt extruded glues. Also, the illustrated activable adhesive layer 316 preferably comprises a permanent adhesive. However, the principles of the present invention are applicable where the activable adhesive comprises a temporary adhesive.

The central portion 334 is configured to present a printable section of the bottom face 324, with the adhesive layer 316 preferably surrounding the central portion 334 to securely conceal the printable section when the label 312 is applied. Preferably, the linerless duplex label 312 further includes top and bottom indicia 338,340 printed on the top and bottom faces 322,324. The bottom indicia 340 is printed on the printable section of the bottom face 324. As will be discussed, the label 312 is preferably adhered to the package P so that the top indicia 338 is exposed and readily viewed and the bottom indicia 340 is cooperatively hidden from view by the label 312 and the package P.

Preferably, the label 312 further includes side perforations 342 and end perforations 344,346,348 that permit the label 312 to be separated into a removable center label section and a surrounding label section. In particular, the perforations 342,344,348 are preferably aligned with the inner adhesive margin 326 so that the removable center label section and the central portion 334 of the stock 314 are substantially co-extensive. Thus, the perforations 342,344,348 cooperatively provide an endless line of weakness that defines the central portion 334, with the central portion 334 being entirely removable from the endless border portion 336. However, it is also within the ambit of the present invention where the perforations 342,344,348 are alternatively configured, e.g., where the perforations are spaced inwardly from the inner adhesive margin 326 or outwardly from the inner adhesive margin 326.

Perforation 346 extends along the central portion 334 between perforations 342 and is inwardly spaced from and adjacent to perforation 348. Perforations 342,346,348 cooperatively define a tear strip 350 of the central portion 334 that connects portions 334,336 of the stock 314 to each other. The illustrated tear strip 350 is removable to present an unsupported margin of the central portion 334 adjacent an end of the label 312. Similar to the first-mentioned embodiment, one or both ends of the tear strip 350 could be alternatively positioned along the label 312. For instance, one or both tear strip ends could extend to the respective side edge of the label stock. The perforations 342,344,346,348 and tear strip 350 can be used similarly to the perforations and tear strip of the first-mentioned embodiment to permit partial or complete removal of the central portion 334 from the border portion 336. Although the label 312 is illustrated as including perforations, it is entirely within the ambit of the present invention to provide the label 312 with no perforations (e.g., where the activable adhesive comprises a temporary adhesive).

As with the first-mentioned embodiment, the duplex printer 304 is preferably a direct-thermal printer so that indicia on label 312 is printed by direct-thermal printing. However, the principles of the present invention are equally applicable where the printer 304 includes a direct-thermal print head, thermal transfer print head, laser print head, an ink jet print head, or combinations thereof (to provide corresponding printing of indicia on label 312 using direct-thermal printing, thermal transfer printing, laser printing, ink jet printing, or combinations thereof). For instance, the printer 304 could have one type of print head that serves as the upper print head to print top indicia 338 on the top face 322 and another type of print head spaced below the upper print head that serves as the lower print head to print bottom indicia 340 on the bottom face 324 (e.g., where indicia on one label face are printed by direct-thermal printing and indicia on the opposite label face are printed by thermal transfer printing). Furthermore, multiple types of print heads could be used to print indicia on the top and/or bottom faces 322,324. Also, some of the indicia, particularly the non-variable indicia, could be pre-printed on the continuous web (i.e., prior to printing by the duplex printer 304).

The label applicator 310 is configured to apply label 312 to package P when the package P is in a labeling position (see FIG. 10). The applicator 310 includes an applicator arm 352 and an applicator pad 354 attached to the end of the arm 352. Preferably, the label applicator 310 further includes a vacuum source (not shown) that is operably coupled to the pad 354. The vacuum source is operable to produce a vacuum condition adjacent a lower pad surface (not shown) of the pad 354 so that the vacuum pressure (i.e., pressure less than ambient pressure) provided by the vacuum source is sufficient to hold the label 312 against the lower pad surface. Also, the vacuum source is operably coupled to a controller (not shown) of the label applicator 310 so that the controller can operate the vacuum source to selectively apply or remove the vacuum condition. Thus, the label applicator 310 is preferably configured so that one of the labels 312 can be held in engagement with the lower pad surface when the vacuum condition is applied.

The arm 352 is slidably mounted to a housing 356 so that the arm 352 can reciprocate relative to the housing 356. The label applicator 310 also preferably includes a motor (not shown), such as a pneumatic or electric servo motor, drivingly attached to the arm 352 and operable to shift the arm 352 relative to the housing 356. The controller of the label applicator 310 is operably coupled to the motor so that the controller can operate the motor to selectively move the arm 352 and pad 354 between a retracted position (see FIG. 10) and an extended position (not shown). In the retracted position, the pad 354 is preferably spaced from the package P (e.g., to allow shifting of the package P into or out of the labeling position). In the extended position, the pad 354 is positioned adjacent to or in direct contact with package P, when the package P is in the labeling position, to apply the label 312 to the package P.

The illustrated label applicator 310 is operable to locate the pad 354 in the retracted position to receive and hold a label 312 for subsequent application to the package P. In the retracted position, the vacuum condition is applied so that the endmost label 312 separated by the cutter 308 is drawn into engagement with the lower pad surface and held in place. Furthermore, the vacuum condition is preferably maintained as the pad 354 and label 312 are shifted from the retracted position to the extended position.

The label applicator 310 is operable to shift the arm 352 and pad 354 into the extended position to apply the held label 312 to the package P. The label applicator 310 can then return the arm 352 and pad 354 from the extended position to the refracted position so that another label 312 can be applied to another package.

The illustrated label applicator 310 also preferably provides an adhesive-activating station. In particular, the applicator 310 preferably includes a heating element 358 mounted within the applicator pad 354 and used to activate the heat-activatable adhesive material of the label 312. The heating element 358 is mounted adjacent the lower pad surface of the label applicator 310.

Preferably, activation of the adhesive material of label 312 is performed after the label 312 is positioned in engagement with the pad 354, although adhesive activation could occur prior to pad engagement. The combined functionality of adhesive activation and label application provided by the illustrated label applicator 310 has been found to be particularly effective for systems that perform label application using a machine, such as an automated label application machine.

The principles of the present invention are also applicable where the label system 300 has an alternative adhesive-activating station. For instance, an alternative adhesive-activating station could have different types of heating elements, such as a heated roller, heated bar, a radiation heating device, or a device that produces hot air.

While the illustrated label applicator 310 preferably includes the heating element 358, an adhesive-activating station could also be provided at a location apart from the label applicator 310. For instance, the station could be disposed downstream of the cutter 308 and upstream of the label applicator 310. In such an arrangement, labels could be fed through the station when traveling from the cutter 308 to the label applicator 310 so that the adhesive layer 316 could be activated by a single pass through the station. Alternatively, the station could be located upstream of the cutter 308 (e.g., to permit activation of the layer 316 prior to separation of the endmost label 312). The use of a separate adhesive-activating station would be particularly useful when performing label application by hand (e.g., where the operator grabs the activated label from the adhesive-activating station and applies the label to the package P by hand) or when performing label application using another manual application method.

The illustrated cutter 308 and adhesive-activating station are preferably located externally to the printer 304. However, it is also within the ambit of the present invention where the cutter 308 and/or the adhesive-activating station are disposed within and made integral to the printer 304.

While heat activation is preferred for activating the adhesive, the system 300 could include an alternative device to activate the adhesive layer 316 (e.g., where the label includes a water-activatable adhesive or a light-activatable adhesive). For instance, the system 300 could include an ultraviolet lamp to activate a light-activatable adhesive. Also, the system 300 could include a moistener device, such as a water reservoir and wetted roller assembly, to moisten and thereby activate a water-activatable adhesive.

In operation, the linerless duplex label system 300 is operable to efficiently apply packing and shipping labels to multiple packages where the label uses an activatable adhesive. The label supply 302 dispenses the continuous web of labels 312 into the printer 304 by unrolling a label 312 from an overlaid disposition with another label 312. As labels 312 pass from the form inlet of the printer 304 to the form outlet of the printer 304 in a single printing pass, indicia 338,340 are printed on top and bottom faces 322,324. The printed labels 312 are then fed out of the form outlet and through the cutter 308 so that the end-most label 312 is separated from the rest of the continuous web.

The illustrated label applicator 310 is positioned in the retracted position to receive and hold the end-most label 312 discharged from the cutter 308. In particular, vacuum is applied to the pad 354 so that the end-most label 312 separated by the cutter 308 is drawn into engagement with the lower pad surface and held in place.

As vacuum is maintained to hold the label 312 in place, the pad 354 and label 312 are shifted from the refracted position to the extended position so that the label 312 is applied to the package P. While the label 312 is held onto the lower pad surface, the heating element 358 is used to apply heat to the label 312 and activate the label adhesive so that the label 312 can be adhered to package P. Adhesive activation could occur at various times while the label 312 is held to the lower pad surface. For instance, the adhesive could be activated prior to shifting of the pad 354 and label 312 out of the retracted position, during shifting of the pad 354 and label 312 from the retracted position to the extended position, after the pad 354 and label 312 are shifted into the extended position, or during a combination of these times. Once the label 312 is applied to the package P, the label applicator 310 is operable to shift the arm 352 and pad 354 from the extended position to the retracted position to receive another label 312.

The label applicator 310 preferably adheres the label 312 onto the package P in a flat and unfolded condition. The bottom face 324 of the adhered label 312 is positioned in adhesive engagement with the package P, and the indicia 340 printed on the bottom face 324 is thereby hidden by the adhered label 312 and package P in a secured label configuration. In addition, the top face 322 is exposed to permit viewing and, if desired, electronic scanning of indicia 338 printed thereon.

Similar to system 20, the system 300 is configured to print and apply a plurality of labels 312 to corresponding packages P, with the indicia on each side of the label 312 being matched with each other and with the package P. The bottom indicia 340 printed along the central portion 334 is exposed for viewing by first removing the tear strip 350 from the portions 334,336 to present the unsupported margin. The recipient can then grasp the exposed margin to remove the central portion 334 from the endless border portion 336, with the central portion 334 thereby serving as a packing slip.

The preferred forms of the invention described above are to be used as illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of the present invention as pertains to any apparatus not materially departing from but outside the literal scope of the invention as set forth in the following claims.

What is claimed is:

1. A linerless duplex single-ply label operable to be applied to a package to provide packing and shipping information for the package, said linerless duplex single-ply label comprising:

an unfolded single label ply forming the only ply of the single-ply label, said unfolded single label ply presenting opposite side border portions, each extending between a respective pair of label corners, said central and side border portions cooperatively presenting opposite top and bottom faces of the single label ply, said top face operable to receive package address indicia and said bottom face operable to receive package contents indicia within the central portion thereof; and an unactivated, selectively activatable adhesive layer applied to the bottom face of the single label ply along the side border portions and the corners of the single label ply, with the side border portions of the single label ply operable to be flatly adhered to the package by the adhesive layer once activated so that the label ply is affixed to the package in an unfolded condition, said unactivated adhesive layer presenting an inner adhesive edge that defines opposite side boundary lines, each of which is between the central portion and a respective one of the side border portions, with the central portion being devoid of adhesive and thereby printable so as to receive the contents indicia thereon, said unactivated adhesive layer permitting removable contact of overlaid linerless duplex single-ply labels to one another without any substantial adhesion therebetween so that once the single-ply label is removed the adhesive layer of the single-ply label may be activated and the single-ply label adhered to the package.

2. The linerless duplex single-ply label as claimed in claim 1, said central and each of said side border portions being separable by a line of weakness extending adjacent the inner adhesive edge and permitting at least partial detachment of the central portion from the side border portions.

3. The linerless duplex single-ply label as claimed in claim 2, said line of weakness being aligned with the inner adhesive edge to permit the central portion to be completely detached from the side border portions.

4. The linerless duplex single-ply label as claimed in claim 2, said central portion including a removable tear strip removably connecting the central and side border portions.

5. The linerless duplex single-ply label as claimed in claim 1, said adhesive comprising a permanent adhesive that restricts removal of the side border portions of the single label ply from the package as a whole.

6. The linerless duplex single-ply label as claimed in claim 1, said single label ply comprising dual sided direct-thermal stock operable to be printed on top and bottom faces by direct-thermal printing.

7. The linerless duplex single-ply label as claimed in claim 1, said adhesive being selected from the group consisting of water-activated adhesive, heat-activated adhesive, and light-activated adhesive.

8. The linerless duplex single-ply label as claimed in claim 1, said unfolded single label ply being four-sided to present four of the label corners.

9. A linerless duplex single-ply label roll operable to provide packing and shipping labels for packages, said linerless duplex single-ply label roll comprising:

a continuous web of a single ply substrate forming the only ply of the single-ply label roll, with the single ply substrate wound in a roll, said single ply substrate presenting a plurality of end-to-end linerless duplex single-ply labels each including an unfolded single label ply that presents opposite side border portions, each extending between a respective pair of label corners, with the unfolded single label ply including a central portion between the side border portions, said central and side border portions cooperatively presenting opposite top and bottom faces of the single label ply, said top face operable to receive package address indicia and said bottom face operable to receive package contents indicia within the central portion thereof, said linerless duplex single-ply labels each including an adhesive layer applied to the bottom face of the single label ply along the side border portions and the corners of the single label ply, with the side border portions of the single label ply operable to be flatly adhered to the package by the adhesive layer so that the label ply is affixed to the package in an unfolded condition, said bottom face of each single-ply label removably contacting the top face of at least one other single-ply label.

10. The linerless duplex single-ply label roll as claimed in claim 9, said adhesive layer presenting an inner adhesive edge that defines opposite side boundary lines, each of which is between the central portion and a respective one of the side border portions, with the central portion being devoid of adhesive and thereby removable from the package and printable so as to receive the contents indicia thereon.

11. The linerless duplex single-ply label roll as claimed in claim 10, said central and each of said side border portions being separable by a line of weakness extending adjacent the inner adhesive edge and permitting at least partial detachment of the central portion from the side border portions.

12. The linerless duplex single-ply label roll as claimed in claim 11, said line of weakness being aligned with the inner adhesive edge to permit the central portion to be completely detached from the side border portions.

13. The linerless duplex single-ply label roll as claimed in claim 11, said central portion including a removable tear strip removably connecting the central and side border portions.

14. The linerless duplex single-ply label roll as claimed in claim 9, said adhesive comprising a permanent adhesive that restricts removal of the side border portions of the single label ply from the package as a whole.

15. The linerless duplex single-ply label roll as claimed in claim 9, said single label ply comprising dual sided direct-thermal stock operable to be printed on top and bottom faces by direct-thermal printing.

16. The linerless duplex single-ply label roll as claimed in claim 9, said adhesive being an unactivated, selectively activatable adhesive selected from the group consisting of water-activated adhesive, heat-activated adhesive, and light-activated adhesive.

17. The linerless duplex single-ply label roll as claimed in claim 9, said unfolded single label ply of each of the linerless duplex single-ply labels being four-sided to present four of the label corners.

18. A labeled package assembly to be shipped to a recipient, said labeled package assembly comprising:

a package containing at least one item to be received by the recipient; and a linerless duplex label applied to the package, wherein opposite sides of the label carry publicly displayed package address indicia associated with the recipient and hidden package contents indicia listing the at least one item, respectively, said linerless duplex label including an unfolded single label ply and an adhesive layer, said unfolded single label ply presenting opposite side border portions, each extending between a respective pair of label corners, with the unfolded single label ply including a central portion between the side border portions, said central and side border portions cooperatively presenting opposite top and bottom faces of the single label ply, said top face carrying the package address indicia and said bottom face carrying the package contents indicia within the central portion thereof so that the central portion provides a packing slip, said adhesive layer applied to the bottom face of the single label ply along the side border portions and label corners of the single label ply, said side border portions and the corners of the single label ply being flatly adhered to the package by the adhesive layer so that the label ply is affixed to the package in an unfolded condition, with the label and package cooperatively concealing the package contents indicia as long as the label is adhered to the package, said adhesive layer presenting an inner adhesive edge that defines opposite boundary lines, each of which is between the central portion and a respective one of the side border portions, with the central portion being devoid of adhesive and thereby printable so as to receive the contents indicia thereon, said adhesive layer permitting removable adhesion of overlaid linerless duplex labels to one another by adhering the top face of one label to the bottom face of another label.

19. The labeled package assembly as claimed in claim 18, said central and each of side border portions being separable by a line of weakness, with the line of weakness extending adjacent the inner adhesive edge and permitting at least partial detachment of the central portion from the side border portions.

20. The labeled package assembly as claimed in claim 19, said line of weakness being aligned with the inner adhesive edge to permit the central portion to be completely detached from the side border portions.

21. The labeled package assembly as claimed in claim 19, said central portion including a removable tear strip removably connecting the central and side border portions.

22. The labeled package assembly as claimed in claim 18, said adhesive layer comprising a permanent adhesive; and a release coating applied to the top face of the single label ply, with the release coating operable to permit removable adhesion of adjacent linerless duplex labels.

23. The labeled package assembly as claimed in claim 22, said release coating covering the top face of the single label ply.

24. The labeled package assembly as claimed in claim 22, said central and side border portions being separable by a line of weakness, with the line of weakness extending adjacent the inner adhesive edge and permitting at least partial detachment of the central portion from the side border portions.

25. The labeled package assembly as claimed in claim 24, said line of weakness being aligned with the inner adhesive edge to permit the central portion to be completely detached from the side border portions.

26. The labeled package assembly as claimed in claim 24, said central portion including a removable tear strip removably connecting the central and side border portions.

27. The labeled package assembly as claimed in claim 18, said single label ply comprising dual sided direct-thermal stock operable to be printed on top and bottom faces by direct-thermal printing.

28. The labeled package assembly as claimed in claim 18, said adhesive layer comprising an activated adhesive.

29. The labeled package assembly as claimed in claim 18, said unfolded single label ply being four-sided to present four of the label corners.

* * * * *